United States Patent [19]

Krol et al.

[11] 4,004,790

[45] Jan. 25, 1977

[54] PLATE-TYPE RADIATOR SUITABLE FOR SHAFT FURNACES, PARTICULARLY FOR BLAST FURNACES, AND A METHOD FOR FABRICATION OF THIS RADIATOR

[75] Inventors: Leszek Krol; Adam Gierek, both of Katowice; Kazimierz Skoczkowski, Raciborz; Stanislaw Bednarczyk, Chorzow; Pawel Mandelka, Swietochlowice; Teodor Nowak, Bytom; Eugeniusz Krzemien, Katowice, all of Poland

[73] Assignee: Huta Kosciuszko, Frzedsiebiorstwo Panstwowe, Chorzow, Poland

[22] Filed: Nov. 19, 1975

[21] Appl. No.: 633,382

[30] Foreign Application Priority Data

Nov. 26, 1974 Poland ..... 175946

[52] U.S. Cl. ..... 266/193; 164/108

[51] Int. Cl.[2] ..... C21B 7/10

[58] Field of Search ..... 122/6 B; 164/98, 108, 164/109, 110, 112; 266/190, 193, 194; 432/238

[56] References Cited

UNITED STATES PATENTS 3,690,633 9/1972 Andoniev et al. ..... 266/193

*Primary Examiner*—Gerald A. Dost

[57] ABSTRACT

Radiator particularly for blast furnaces has a shape of plate and outer box 1 made of cast iron with 1% addition of chromium. Inside outer wall of the box there is installed a cooling coil 2. From the interior the radiator is provided with a lining of semi-graphite sections.

Method of production of the radiator consists in preparing a form of cement mix for casting the box in a floor by using a model, after hardening mold cavity is spreaded with a protective coating, preferably water-graphite one and after the mold is dried there are placed semi-graphite sections. To the top portion of the form, made of chamotte mass, there is fixed a cooling coil and the whole form is filled with cast iron by the hitherto applied method. For cast iron there is used the addition of 1% of chromium, being introduced in a form of self-meltable ferrochromium preferably into the vat.

3 Claims, 3 Drawing Figures

PLATE-TYPE RADIATOR SUITABLE FOR SHAFT FURNACES, PARTICULARLY FOR BLAST FURNACES, AND A METHOD FOR FABRICATION OF THIS RADIATOR

This invention relates to a plate-type radiator suitable for using in shaft furnaces, particularly in blast furnaces, and to a method for fabrication of this radiator. The invented radiator may be used in the zone of heart, of boshes, of waist or in the bottom portion of a blast furnace, this radiator being also suitable for shaft furnaces used in production of copper and zinc.

The previously proposed radiators, particularly those used in blast furnaces, are made in the form of a cast iron box whose arch-like outline is suited to the shape of the jacket of a blast furnace, the radiator being lined with shaped fire clay pieces with expansion joints provided between them and filled with asbestos, these joints preventing the casting stresses and compensating an irregular expansion of fire clay lining and of a cast iron housing. In order to abstract the heat, there are pipes cast-in in the walls of the metal box, a cooling water flowing through these pipes when the furnace operates.

The radiators of this type are suffering from several imperfections.

Casting stresses are produced by a liquid iron in the fire clay lining with asbestos filled expansion joints, these stresses occuring in spite of expansion joints which are used. The casting stresses are caused by different coefficients of thermal expansion and they cause, in turn, cracking of the radiator either at the time of its cooling down or at the time of furnace campaign. Using of asbestos separators causes that the heat is not uniformly distributed over the cooling plate and that irregular stresses are produced, this causing, in turn, cracking of the cast metal cooling plates and leaking of water into the blast furnace. It has also been learned that heat abstraction in a fire clay lined radiator is insufficient, particularly in places where the asbestos separators are provided. This results in a premature deterioration of fire clay lining in the zone of heart, of boshes, of waist or in the bottom portion of a blast furnace, and there are the cases known where the lining of the blast furnace was subject of destruction after 2 to 6 months of the furnace life, while the lining of the radiator was chipping. Forming of a "varnish" inside the furnace is proceeding too slow thus causing a premature deterioration of the lining.

Fabrication of radiators of the known type is difficult and there is a large number of spoilage in production, the produced radiators are subject to internal stresses which cause cracking, and there is a high thermal resistance for heat abstraction in these radiators thus causing a premature deterioration of fire clay lining in the furnace.

The object of the present invention is to provide a radiator of plate-type construction suitable for use in shaft furnaces, and particularly in blast furnaces in the zone of heart, of boshes, of waist or in the bottom portion of the furnace, this radiator being simple in production without spoilage, and being no subject to casting stresses. Another object of the present invention is to provide a radiator of high resistance against destructive effects in operation of a furnace, this radiator abstracting the heat at a more intensive rate in comparison with the radiators previously used, this increased heat abstracting capability being accomplished in order to accelerate the formation of a varnish on the furnace lining.

The above mentioned technical effects have been achieved by developing a radiator in accordance with the present invention, this radiator having a conventional geometrical shape and comprising cooling pipes cast-in into a cast iron box, a characteristic mark of this radiator being its lining made, at the side facing the interior of the furnace, in the form of semi-graphite straight sections. The radiator is fabricated by casting of a box by means of a model, by spreading the mould cavity with a protective coating preferably in the form of a water-graphite coating, and by placing in the bottom section of the mould the semi-graphite straight sections in such a way that they are abutting one the other and are sucured against being forced out, and then a cooling coil is placed, in a known arrangement, in the top section of the mould, the mould being then cast with a liquid low-alloy cast iron preferably with an addition of chromium.

A radiator thus fabricated offers several advantages. The stresses produced in the casting of a cast iron box are minimum thus considerably reducing spoilage in production of radiators, and the radiator has a longer life because there are no initial stresses occuring in the cooling pipes. An important beneficial characteristic of the radiator is its higher heat abstraction rate because the thermal conductivity of semi-graphite straight sections is about ten times higher than that of fire clay products. A started furnace attains very quickly its normal working readiness in required conditions, and a varnish is almost once formed on the inner surface of lining, this varnish staying there until the furnace campaign is completed. Another factor which extends the life of the radiator is a high resistance of semi-graphite straight sections against chemical effects in operation of the blast furnace, and a resistance against high temperatures. Still another advantage is the fact that expansion joints filled with asbestos are not required between the straight sections, these joints being subject to chipping thus causing the deterioration of the whole radiator and hindering an unhampered heat propagation in vertical direction.

An embodiment of the present invention will now be described by way of example and with reference to the accompanying drawing in which.

Figure 1:
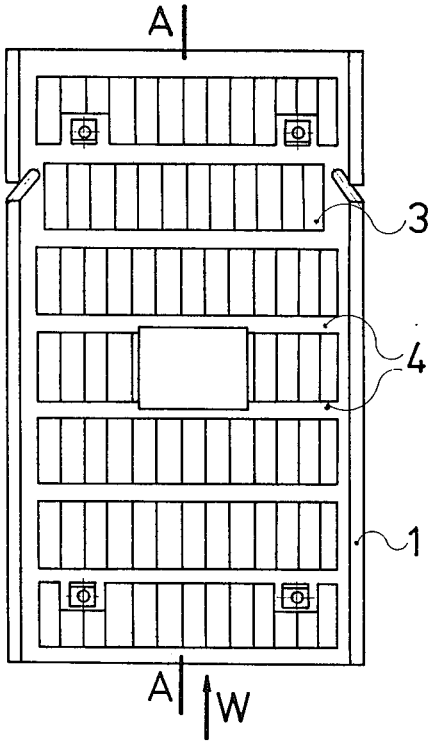
FIG. 1 illustrates the radiator as viewed from the side of the lining.
Figure 2:
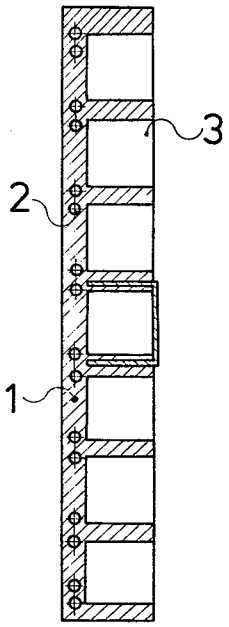
FIG. 2 illustrates the radiator in a section A—A indicated in FIG. 1.
Figure 3:
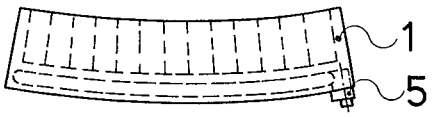
FIG. 3 illustrates the radiator in a top view indicated in FIG. 2 with character W.

The invented radiator includes a cast iron box 1 cast in a low-alloy iron with an addition of about 1% of chromium. A conventional cooling coil 2 is cast in into the outer wall of box 1. Semi-graphite straight sections 3 are installed, one abutting the other, in between ribs 4, said straight sections being secured during the casting process against being forced out. The coil 2 has end pipes leading outside the cast iron box 1, said end pipes being provided with stub pipes 5 for connecting the water inlet and outlet, said coil being coated with a layer of material protecting it against carbonizing, with e.g. zirconium oxide, at the time when the mould is being filled with liquid iron. The semi-graphite preferred for using in straight sections 3 should have the following properties:

thermal conductivity at 20° C – 25 kcal/m . h° C;
coefficient of thermal expansion at the temperature within 20° to 100° C – 3.0 . 10–6 1/° C;
specific heat — 0.2 kcal/kg ° C; and
strength — 220 kg/cm².

The invented radiator is fabricated as follows: the mould for casting of cooling plate is made of cement mix and a model is used for forming of the mould. The mould is pre-hardened and the mould cavity is coated with a water-graphite protective coating, and then, after the mould is dried, semi-graphite straight sections 3 are installed in the mould, said straight sections abutting one the other without any expansion joint used between them. The semi-graphite straight sections 3 are being secured against forcing them out during casting process. The top section of the mould is made of a fire clay moulding mix, and the coil 2 is fixed to the said top section by means of hooks. A mould thus prepared is assembled and then filled with a preferably low-chromium liquid iron. The casting temperature should be within about 1,190° to 1,220° C. The casting is left in the mould for about 24 hours after the casting process, and then the top section of the mould can be removed. Removing of the casting from the mould can follow after another 12 hours, it can be then subjected to cleaning and inspection, and be fitted with stub pipes 5 for connecting the water inlet and outlet.

There are minimum casting stresses occuring in a radiator fabricated in accordance with the above described method thus eliminating the spoilage in production and extending the life of the radiator once it is installed in a furnace. A radiator of this type considerably extends the period between the overhauls of the furnace, because the heat conductivity of semi-graphite straight sections is many times higher than that of fire clay sections used in the radiators hitherto.

A protective zirconium layer used on the cast-in pipes, and thus the exclusion of hardening of the walls of coil, eliminates cracking of pipes even in the case of a crack in the casting. The semi-graphite straight sections are highly resistant against chemical effects and against high temperatures. The fact that expansion joints and asbestos separators are eliminated in between the semi-graphite straight sections allows the heat to propagate freely and uniformly in all directions in the radiator. Summing up, the invention considerably adds to extension of periods between the overhauls of a blast furnace. The tests which have been made corroborate the practical employability of invention and there are several invented radiators which already satisfactorily operate in blast furnaces without any troubles. The invented radiator may be installed in an already existing blast furnace at the time of its overhaul, as well as in the newly designed furances. It can be employed in the zone of heart, of boshes, of waist, as well as in the bottom section of a blast furnace. The invention presents an advanced and modern solution of cooling problems in blast furnaces, and radiators provided with semi-graphite lining offer the optimum conditions for operating of a blast furnace.

What we claim is:

1. A plate-type radiator suitable for using in shaft furnaces and particularly in blast furnaces, said radiator having a conventional geometrical shape and including cooling pipes cast-in in a cast iron box, wherein a lining made of semi-graphite straight sections 3 is provided at the radiator side facing the interior of a furnace.

2. A method for fabrication of radiator as claimed in claim 1, said method consisting in forming of the casting of the metal box by means of a model and in coating of the mould cavity with a protective coating, preferably with a water-graphite coating, wherein the semi-graphite straight sections are placed in the bottom section of the mould, said straight sections abutting one the other or the casting, while a cooling coil is installed in a conventional manner in the top section of the mould, the mould being then filled with a liquid iron.

3. A method as claimed in claim 2, wherein the mould is filled with a liquid low-alloy iron with an addition of chromium.

* * * * *